US005864576A

United States Patent [19]

Nakatani et al.

[11] Patent Number: 5,864,576

[45] Date of Patent: Jan. 26, 1999

[54] ELECTRIC FURNACE

[75] Inventors: Masanori Nakatani; Takeshi Abe; Toshio Kawanami, all of Sakai, Japan

[73] Assignee: Nikkato Corp., Osaka-fu, Japan

[21] Appl. No.: 930,289

[22] PCT Filed: Jan. 30, 1997

[86] PCT No.: PCT/JP97/00217

§ 371 Date: Oct. 1, 1997

§ 102(e) Date: Oct. 1, 1997

[87] PCT Pub. No.: WO97/28409

PCT Pub. Date: Aug. 7, 1997

[30] Foreign Application Priority Data

Feb. 1, 1996 [JP] Japan ..... 8-016586

[51] Int. Cl.[6] ..... H05B 3/60

[52] U.S. Cl. ..... 373/125; 373/114; 373/117; 373/128; 219/408

[58] Field of Search ..... 373/109, 111, 373/117–119, 125, 126; 219/383, 390, 406, 408, 409

[56] References Cited

U.S. PATENT DOCUMENTS

| | | | |
|---|---|---|---|
| 2,121,744 | 6/1938 | Ridgway et al. | 373/111 |
| 3,128,325 | 4/1964 | Andersen et al. | 373/111 |
| 4,041,236 | 8/1977 | Dumont et al. | 373/117 |
| 4,490,828 | 12/1984 | Fukuhara et al. | 373/117 |

FOREIGN PATENT DOCUMENTS

| | | |
|---|---|---|
| 50-15315 | 6/1975 | Japan . |
| 3-32503 | 7/1991 | Japan . |
| 4-36076 | 8/1992 | Japan . |
| 5343170 | 12/1993 | Japan . |
| 6016471 | 1/1994 | Japan . |

*Primary Examiner*—Tu Ba Hoang
*Attorney, Agent, or Firm*—Knobbe, Martens, Olson & Bear, LLP

[57] ABSTRACT

An electric furnace includes a heating element which is a hollow element made of a lanthanum chromite ceramic having an interior with two open ends in an longitudinal direction, terminal portions at the two ends, and a heat-generating portion between the terminal portions. The terminal portion has a cross-sectional area larger than that of the heat-generating portion on a plane perpendicular to the longitudinal direction. The heating element is provided with high-temperature electrodes and metallic lead wires attached to the terminal portions to generate heat in the heat-generating portion. The electric furnace further includes a heat-insulating material surrounding the heating element, and a hollow ceramic member placed in the interior of the heating element.

9 Claims, 9 Drawing Sheets

ELECTRIC FURNACE

FIELD OF THE INVENTION

The present invention relates to an electric furnace which can be used stably even at a high temperature of not lower than 1,400° C. and which is superior in durability.

BACKGROUND ART

Electric furnaces are required to have various performance characteristics such as an ability to rapidly elevate the temperature, superior stability in a high-temperature oxidizing atmosphere, good durability against continuous use at high temperatures and against repeated increase and decrease of temperatures, a long length of soaking zone in a heating chamber, high handleability and the like.

Conventional electric furnaces equipped with resistance heating elements have the structure shown in FIGS. 1A and 1B wherein a plurality of cylindrical heating elements 12 are arranged around a furnace tube 13 used as a heating chamber, and wherein said heating elements are surrounded with a heat-resistant tube 14, heat-insulating layers 15 and 16 and an external casing 17 in this order.

However, the electric furnaces of this structure are adapted to indirectly heat the heating chamber by radiation of Joule heat from the cylindrical heating elements 12, and thus require a number of heating elements 12, involving a drawback of having a complicated structure and a great size as compared with the effective volume of the heating chamber. Such electric furnaces have posed problems such as poor durability due to low heating efficiency. Further, other problems exist in terms of the service life of heating elements and economy, because the constituent materials for electric furnaces have a large heat capacity and great electric power is required for heating to a predetermined temperature and in maintaining the temperature.

DISCLOSURE OF THE INVENTION

A primary object of the present invention is to provide a small-size electric furnace which can be used stably even at a high temperature of not lower than 1,400° C., the furnace being superior in durability and handleability and economically advantageous.

The present inventors conducted extensive research to overcome the foregoing problems and found the following. The inventors used, as a heating element, a hollow lanthanum chromite ceramic element opened at both ends and having the following structure. The hollow ceramic element has terminal portions at both ends, and the terminal portions are larger in the cross-sectional area of the ceramic than a central portion of the element. High-temperature electrodes and metallic lead wires are attached to the terminal portions. When said heating element is used, the heating efficiency can be improved and the resulting electric furnace has a small-size, simplified structure. The electric furnace of specific construction produced using the heating element of said structure is excellent in durability, handleability and the like and economically beneficial. Further, when a lanthanum chromite ceramic having a specific composition and specific properties is used as the material for a heating element, an electric furnace of improved durability can be obtained. Based on these novel findings, the present invention was completed.

The present invention provides an electric furnace comprising:

a heating element which is a hollow element made of a lanthanum chromite ceramic and opened at both ends;

a heat-insulating material laid outside the heating element; and a hollow ceramic member placed in the empty space in the interior of the heating element, said heating element having, at both ends, terminal portions which are larger in the cross-sectional area of the ceramic on a plane perpendicular to the longitudinal direction of the element than a central portion of the element, high-temperature electrodes and metallic lead wires being attached to the terminal portions, the portion between the terminal portions being used as a heat-generating portion, and the empty space in the interior of the hollow ceramic member being used as an effective heating chamber.

BRIEF DESCRIPTION OF THE DRAWINGS

FIG. 1 (B) is a cross-sectional view of the conventional tubular electric furnace.

FIG. 2 (B) is a cross-sectional view of the electric furnace of the invention.

FIG. 9 (B) is a cross-sectional view of another example of the electric furnace according to the invention.

FIG. 10 (B) is a cross-sectional view of the electric furnace of Example 3.

FIG. 11 (B) is a cross-sectional view of the electric furnace of Example 4.

Figure 1A:
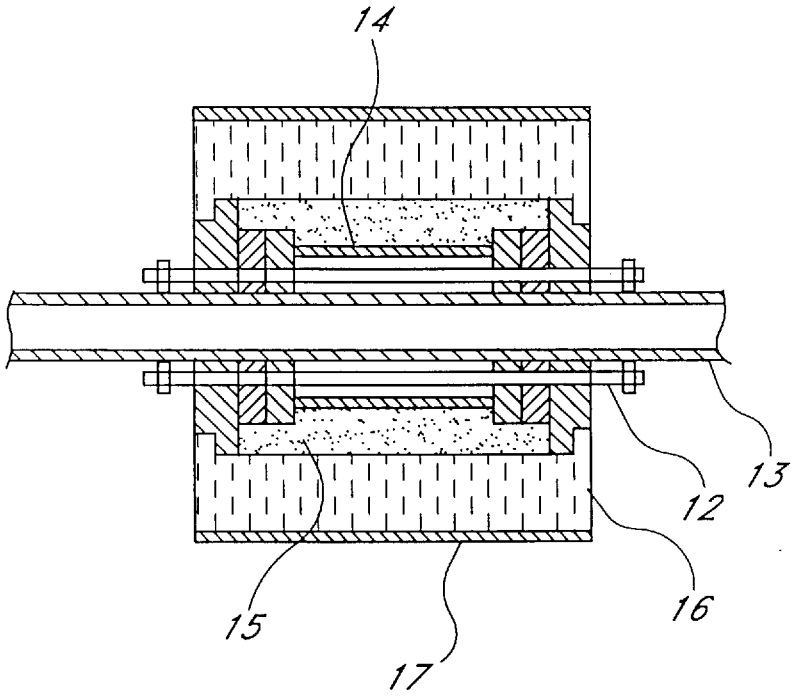
FIG. 1A (PRIOR ART)
FIG. 1 (A) is a longitudinal section of a conventional tubular electric furnace.
Figure 1B:
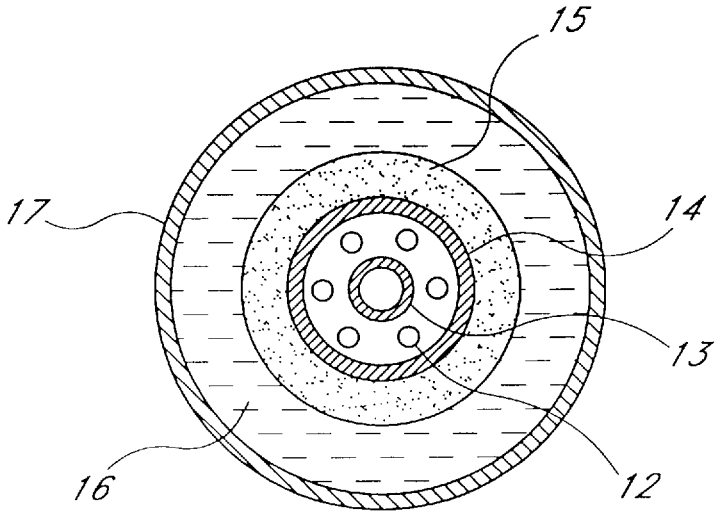
FIG. 1B (PRIOR ART)

In the drawings, reference numerals 1 and 2 designate a heating element and a terminal portion, respectively. Reference numerals 3, 3*a* and 3*b* designate heat-generating portions. An electrode for use at high temperatures (high-temperature electrode) is designated 4 and a metallic lead wire, 5. Designated 6 is a hollow ceramic member (furnace tube) and designated 7 is a heat-insulating material. Indicated at 8 is a boundary between the terminal portion and the heat-generating portion; at 9, a groove formed in the terminal portion for winding a metallic lead wire therein; at 10, a ceramic layer; at 11, a slit; at 12, a cylindrical heating element; at 13, a furnace tube; at 14, a heat-resistant tube; at 15, a heat-insulating layer; at 16, a heat-insulating layer; and at 17, an external casing.

DETAIL DESCRIPTION OF THE PREFERRED EMBODIMENTS

The electric furnace of the invention is described below with reference to the accompanying drawings.

Figure 2A:
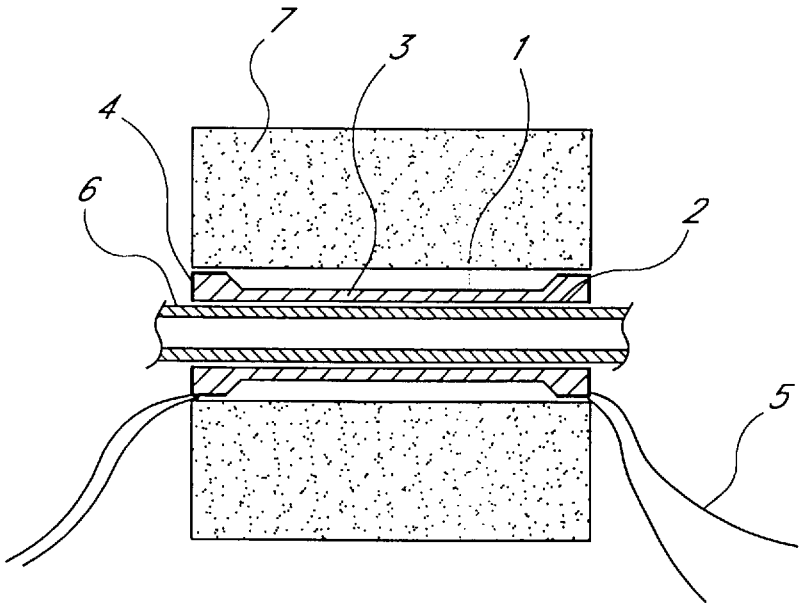
FIG. 2 (A) is a longitudinal section of the electric furnace of the present invention.
Figure 2B:
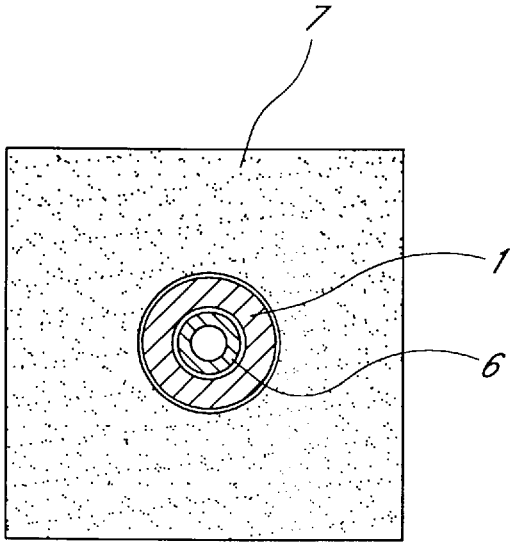

FIG. 2 shows sectional views illustrating an example of the electric furnace of the invention.

In FIG. 2, the heating element 1 is a hollow element made of a lanthanum chromite ceramic and opened at both ends. The two end portions of the hollow element are larger in the cross-sectional area of the ceramic on a plane perpendicular to the longitudinal direction of the element than the center portion thereof. These end portions are terminal portions 2. High-temperature electrodes 4 and metallic lead wires 5 are attached to the terminal portions 2. The portion between the terminal portions is used as a heat-generating portion 3.

Since the empty space in the interior of the heating element 1 of such structure, i.e. a hollow lanthanum chromite ceramic element opened both ends, is utilized as a heating area, a single heating element can be used in place of a plurality of heating elements heretofore essentially used and can provide an electric furnace with a small-size, simplified structure. Because the temperature is higher in the empty space in the interior of the heating element 1 than on its external surface, and the hollow space is used as a heating area, electric power can be efficiently converted to heat. Due to this feature in addition to the small-size, simplified structure, a maximum operating temperature of the electric furnace can be set at a higher level and the service life of electric furnace can be extended. Furthermore, since the empty space in the interior of the heating element 1 is used as a heating area, the internal temperature of the furnace is rendered more responsive to electric power and the durability against heat cycle is enhanced.

In the heating element 1, the two end portions are essentially used as the terminal portions 2. The terminal portions 2 have a larger cross-sectional area of the ceramic on a plane perpendicular to the longitudinal direction of the element than the center thereof. Due to this structure, the terminal portion 2 is made lower in resistance than the central portion of the element as a heat-generating portion 3. Since the high-temperature electrodes 4 and the metallic lead wires 5 are fixed to the terminal portions 2, the electrodes are prevented from exposure to high temperatures, whereby the materials for the electrodes 4 and metallic lead wires 5 are inhibited from degradation, resulting in improved durability of the electrodes 4 and metallic lead wires 5, consequently in enhanced durability of the heating element 1, namely the electric furnace. Conventional heating elements have terminal portions lowered in resistance due to the formation of terminal portions different in composition from the heat-generating portion. Such heating elements, however, have a drawback of showing low resistance to thermal shock because high thermal stress is caused owing to a difference in the coefficient of thermal expansion between the terminal portions and the heat-generating portion. In the present invention, as described above, the heating element is uniform in the composition, and the resistance of the heat-generating portion and terminal portions can be varied by altering their shape, so that a high resistance to thermal shock is exhibited because a difference in the coefficient of thermal expansion is not involved.

It is desirable that the empty space in the interior of the heating element 1 have a cross-sectional area of 1 to 2,000 $mm^2$ on a plane perpendicular to the longitudinal direction of the element. If the cross-sectional area of the empty space is less than 1 $mm^2$, the electric furnace is not suitable for practical use, whereas if it is in excess of 2,000 $mm^2$, the furnace would be likely to have an irregular internal temperature distribution, tending to become impaired in durability and other properties.

Figure 3:
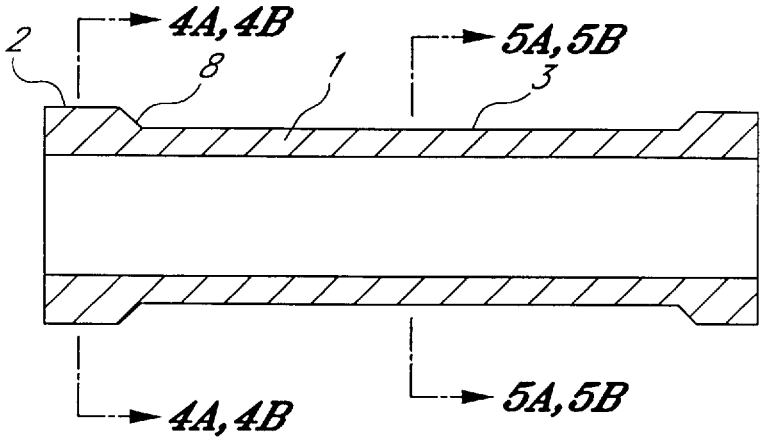
FIG. 3 is a longitudinal section of a heating element to be used in the electric furnace of the invention.
Figure 4A:
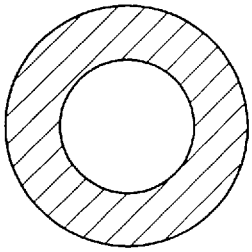
FIG. 4 shows cross-sectional views taken along the line a-a' in FIG. 3.
Figure 4B:
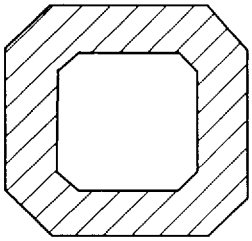
Figure 5A:
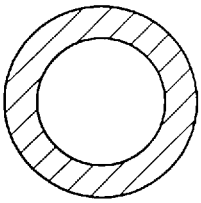
FIG. 5 shows cross-sectional views taken along the line b-b' in FIG. 3.
Figure 5B:
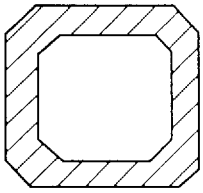

The heating element 1 may be circular, angular or otherwise shaped in the cross section on a plane perpendicular to the longitudinal direction of the element. FIG. 3 shows, in longitudinal section, an example of said heating element. FIG. 4 shows cross-sectional views of a terminal portion 2 in the heating element of FIG. 3, namely cross-sectional views taken along the line a-a' in FIG. 3. FIG. 4 (A) shows an example of a circular cross section and FIG. 4 (B), an example of an angular cross section. FIG. 5 shows cross-sectional views of a heat-generating portion 3 in the heating element 1 of FIG. 3, namely cross-sectional views taken along the line b-b' in FIG. 3. FIG. 5 (A) shows an example of a circular cross section and FIG. 5 (B), an example of an angular cross section. There exists a relation of $S_2>S_3$ wherein $S_2$ represents the sectional area of the terminal portion 2 shown in FIG. 4 and $S_3$ represents the sectional area of the heat-generating portion 3 shown in FIG. 5.

The sectional area ratio $S_2:S_3$ (sectional area of the ceramic of terminal portion 2:sectional area of the ceramic of heat-generating portion 3) is preferably about 1.2–5:1, more preferably about 1.5–3:1. If the sectional area ratio is less than 1.2:1, the terminal portion 2 is not sufficiently low in resistance compared with the heat-generating portion 3, whereas if the sectional area ratio is in excess of 5:1, the external dimensions of the terminal portion 2 are too large, resulting in lower heating efficiency and in an oversize shape of electric furnace. Hence the ratio outside said range is undesirable. The external dimensions of the heat-generating portion in the heating element are properly set according to the design of the electric furnace so as to give a thickness of about 0.5 to about 10 mm.

Figure 6:
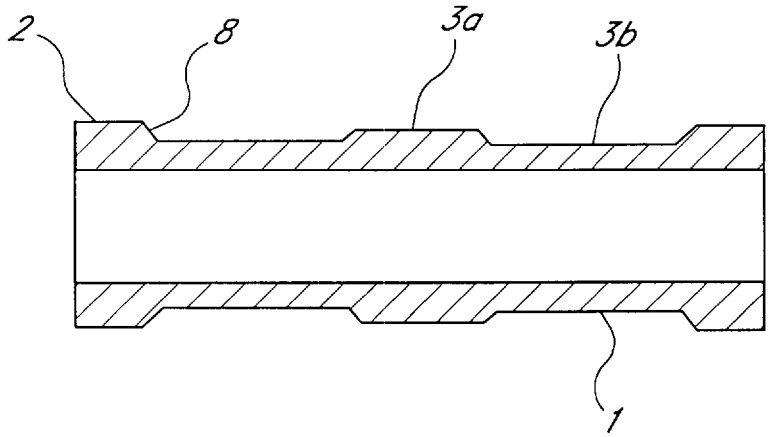
FIG. 6 is a longitudinal section showing another example of the heating element to be used in the electric furnace of the invention.

Preferably a boundary 8 between the terminal portion 2 and the heat-generating portion 3 has a sectional shape gradually diminishing from the terminal portion 2 toward the heat-generating portion 3 as shown in FIG. 3 and FIG. 6 to avoid an abrupt change of resistance value, but its sectional area is not limited to such shape.

The external dimensions of the heat-generating portion 3 in the heating element 1 need not be constant. The cross-sectional area of the ceramic of the heat-generating portion 3 on a plane perpendicular to the longitudinal direction may be partly varied in the range in which it is smaller than the cross-sectional area of the ceramic of the terminal portion 2 on a plane perpendicular to the longitudinal direction. FIG. 6 shows, in longitudinal section, an example of such heating element. The heating element 1 shown in FIG. 6 has a heat-generating portion 3*a* having a sectional area $S_{3a}$ within the range of $S_2>S_{3a}>S_{3b}$ wherein $S_2$ is the sectional area of the terminal portion 2 and $S_{3b}$ is the sectional area of the heat-generating portion 3*b*. When a heating element of such shape is used, the temperature distribution in the electric furnace is improved, resulting in an extended length of soaking zone wherein the temperature distribution is substantially constant. The sectional area ratio of $S_{3a}:S_{3b}$ in the heat-generating portion can be properly determined depending on the design of the electric furnace. If $S_{3a}$ is far larger than $S_{3b}$, high electric power is consumed in heating, ultimately affecting the service life of the electric furnace. Hence it is undesirable. The sectional area ratio of $S_{3b}:S_{3a}$ in the heat-generating portions 3*b* and 3*a* is preferably about 1:1.1–3, more preferably about 1:1.3–2. The heat-generating portion may have such slightly larger sectional area not only at one position but at plural positions depending on the design of the electric furnace.

The heating element 1 is essentially made of a lanthanum chromite ceramic ($LaCrO_3$) which is stable in a high-temperature oxidizing atmosphere. Because of this feature, the heating element 1 can be used in an electric furnace operative at a high temperature of not lower than 1,400° C.

In the heating element 1 made of a lanthanum chromite ceramic, Cr is evaporated off at a high temperature due to surface diffusion. With an increase of porosity, the evaporation amount rises and the heating element 1 becomes less durable. Thus the porosity is preferably 10% or less, more preferably 8% or less.

The lanthanum chromite ceramic as the material for the heating element 1 is used preferably in the form of a sintered product represented by the formula $$La_{1-x}A_xCr_{1-y-z}Mg_yAl_zO_3$$

wherein A is at least one of Ca and Sr, $0 \leqq x \leqq 0.12$, $0 \leqq y \leqq 0.20$, $0 < z \leqq 0.50$, $0.005 \leqq x+y \leqq 0.20$ and $0.03 \leqq y+z \leqq 0.50$. A heating element of such lanthanum chromite ceramic has more improved durability.

The ceramic represented by said formula is a substitutional solid solution wherein La is partly substituted with an A component (at least one of Ca and Sr) or Cr is partly substituted with Mg, or wherein La is partly substituted with an A component and at the same time Cr is partly substituted with Mg. The ceramic having such composition is imparted a high degree of sinterability and high electroconductivity sufficient to directly send an electric current at room temperature. However, if there is an excessive increase in a value x (substitution amount of A component), tetravalent Cr is increased, whereby the vaporization of Cr at a high temperature is intensified, leading to more pollution of internal furnace and to more degradation of heating element. Hence it is undesirable. To avoid this problem, a value x is within the range of $0 \leqq X \leqq 0.12$, preferably $0.005 \leqq x \leqq 0.08$, more preferably $0.01 \leqq x \leqq 0.05$. Mg as well as A component contributes to improvements in electroconductivity and degree of sinterability. When A component exists in a large amount, y=0 is within a proper limit. Yet, when x=0 or a value x is very small, y>0 is preferred to assure electroconductivity. When a value y is in excess of 0.2, a single phase of perovskite structure is not formed. Hence it is undesirable. Therefore, the value y is within the range of $0 \leqq y \leqq 0.20$, preferably $0 \leqq y \leqq 0.10$. The total substitution amount of A component and Mg is within the range of $0.005 \leqq x+y \leqq 0.20$, preferably $0.01 \leqq x+y \leqq 0.15$. When x+y is less than 0.005, sufficient degree of sinterability and electroconductivity can not be insured. On the other hand, when x+y is more than 0.20, the evaporation of Cr at a high temperature is intensified and the heating element is given too high electroconductivity, whereby a low-voltage, high current-driving heating element is provided, posing a new problem of locally evolving heat if the contact resistance is not held low between the electrodes and the metallic lead wires and if the wiring resistance of metallic lead wires or the like is not kept low. Hence it is undesirable.

In the ceramic of said formula, Al is effective to improve the degree of sinterability and to decrease the porosity, and a value z, which is the substitution amount of Al, is $0 < z \leqq 0.50$, preferably $0.02 \leqq z \leqq 0.40$, more preferably $0.03 \leqq z \leqq 0.30$. When a value z is above 0.50, the electroconductivity is markedly lowered and heat resistance is decreased. Hence it is undesirable. The total substitution amount of Mg and Al is within the range of $0.03 \leqq y+z \leqq 0.50$, preferably $0.05 \leqq y+z \leqq 0.40$. When y+z is less than 0.03, the degree of sinterability and the electroconductivity are not effectively improved. On the other hand, in the case of over 0.50, the heat resistance and the electroconductivity are reduced. Hence it is undesirable.

In the present invention, it is more preferable that the heating element 1 be made of a sintered product represented by the formula $La_{1-x}A_xCr_{1-y-z}Mg_yAl_zO_3$, the sintered product having a porosity of 10% or less. This is because such sintered product shows good durability.

The sintered product of the formula $La_{1-x}A_xCr_{1-y-z}Mg_yAl_zO_3$ may be in the form of a substitutional solid solution wherein 1 to 35 mole % of La is substituted with at least one of yttrium and rare earth elements of atomic numbers 58–71. A sintered product of such composition shows a high degree of sinterability and is free from marked decrease of heat resistance and electroconductivity.

Further, the heating element 1 is preferably at least 8 kgf/mm$^2$, more preferably at least 10 kgf/mm$^2$, in bending strength at room temperature. When the heating element 1 is made of a sintered product represented by the formula $La_{1-x}A_xCr_{1-y-z}Mg_yAl_zO_3$, the sintered product having a porosity of 10% or less and a bending strength of at least 8 kgf/mm$^2$, the durability against heat cycle is improved even when the temperature is elevated and lowered in a short time, and the potential pollution of an object to be heated is alleviated because the vaporization of the heating element 1 is inhibited. Accordingly the heating element 1 is given an extended duration of life.

In the present invention, the high-temperature electrodes 4 and metallic lead wires 5 are essentially fixed to the terminal portion 2. The electrodes 4 and metallic lead wires 5 may be made of any of conventional materials heretofore used for electric furnaces, such as gold, silver and the like, preferably metallic materials having a high melting point, e.g. platinum, rhodium, platinum/rhodium alloys, etc. When such metallic material having a high melting point is used, not only the duration of life can be prolonged, but also it becomes less necessary to partly expose the electrodes and terminal portion to an external environment as in conventional electric furnaces, and the length of the terminal portion can be shortened, thereby appreciably enhancing the thermal shock resistance of the heating element.

Figure 7:
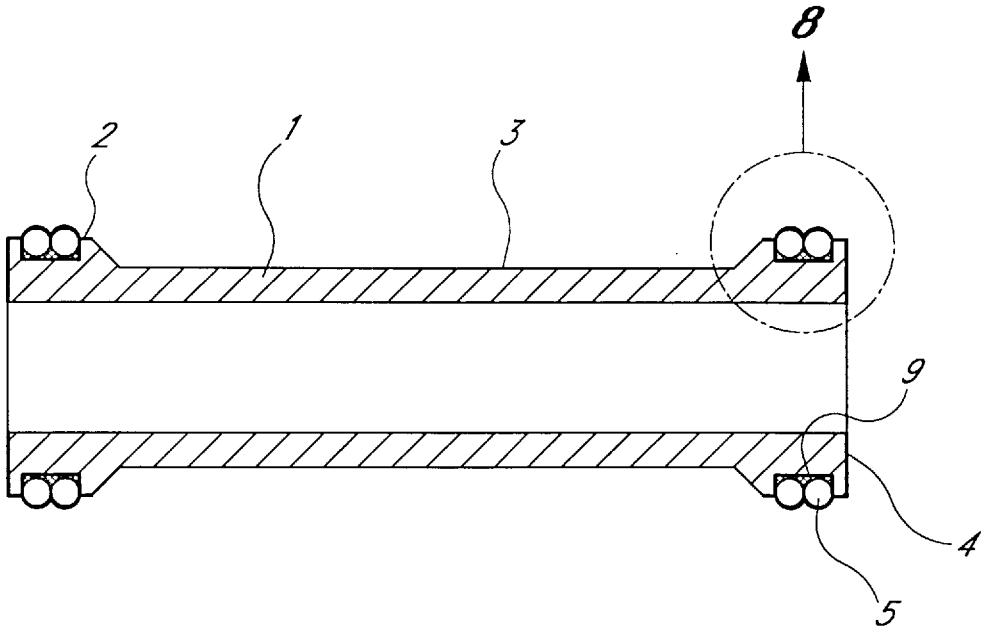
FIG. 7 is a longitudinal section showing an example of a heating element having electrodes and metallic lead wires fixed thereto.
Figure 8:
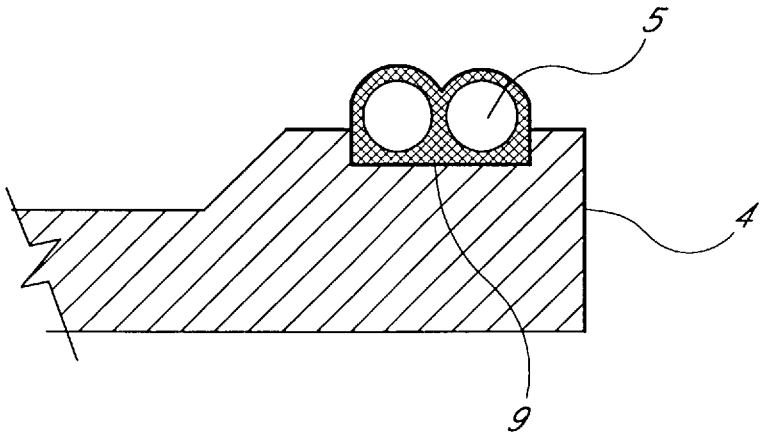
FIG. 8 is a partially enlarged view showing an area A as a terminal portion in the heating element of FIG. 7.

The methods of fixing the electrodes 4 and the metallic lead wires 5 are not specifically limited. The electrodes 4 and the metallic lead wires 5 can be fixed to the terminal portion 2 by conventional methods in a manner to impart a stable fixation and the lowest possible resistance. FIG. 7 is a longitudinal section showing an example of a heating element having electrodes 4 and metallic lead wires 5 fixed thereto. FIG. 8 is a partially enlarged view of an area A shown as the terminal portion in FIG. 7. In the illustrated heating element 1, a groove 9 for winding a metallic lead wire therein is formed in the terminal portion 2. A paste of a material for the electrodes 4 is applied to the outer peripheral surface of the terminal portion 2 including the groove 9 and also to the end surface thereof, and then the metallic lead wire 5 is wound in the groove 9 to which the paste for the electrodes 4 is again applied, followed by sintering the material for the electrode. According to such fixing method, the electrodes 4 and the metallic lead wires 5 can be kept properly adhering to the terminal portions 2 while showing a lower contact resistance, and the metallic lead wires can be stably fixed, so that an extended duration of life can be imparted to the heating element. The foregoing method of fixing the electrodes 4 and the metallic lead wires 5 can be applied to the heating element having any of shapes such as shown in FIGS. 3 and 6. The electrodes 4 are not necessarily formed on the outer peripheral surface of the terminal portion 2 and the end surface thereof in their entirety. The ambit for forming the electrodes can be appropriately determined such that the metallic lead wires can be stably fixed according to the shape of the terminal portion 2 and that the contact resistance and the wiring resistance are minimized.

A hollow ceramic member 6 is placed in the empty space in the interior of the heating element 1. The empty space in the interior of the hollow ceramic member 6 is used as an effective heating chamber.

The hollow ceramic member 6 is the so-called furnace tube. An object to be heated is inserted into the furnace tube, whereby the object to be heated can be prevented from pollution by a vapor evolved from the heating element 1. The hollow ceramic member 6 may have various sectional shapes such as a circular or angular sectional shape on a plane perpendicular to the longitudinal direction of the member 6. The thickness of the hollow ceramic member 6 may be properly selected over the range of about 0.2 to about 5 mm depending on the design of the electric furnace. Also the length of the hollow ceramic member 6 can be properly selected and for example, may be the same length as or longer than, the heating element 1 depending on the design of the electric furnace. The external dimensions of the hollow ceramic member 6 may be properly determined according to the design of the electric furnace. While the hollow ceramic member 6 may be brought into contact with the heating element 1, the member 6 out of contact with the heat-generating portion 3 more effectively inhibits the pollution of an object to be heated.

The hollow ceramic member 6 can be produced from ceramics heretofore used for furnace tubes of electric furnaces. There is no specific limitation on the purity and relative density of ceramics to be used. However, it is desirable to use alumina, mullite, spinel, stabilized zirconia (at least 95% in the purity of a mixture including a stabilizer), magnesia or yttria which have a purity of at least 95% and a relative density of at least 93%. The hollow ceramic member 6 made of these materials have more enhanced heat resistance, can be kept from undergoing a reaction with the heating element 1 and can more effectively inhibit the pollution of an object to be heated. Useful ceramics are preferably those having a purity of at least 97% and a relative density of at least 95%, more preferably those having a purity of at least 99%.

The heating efficiency of the electric furnace can be increased when the heating element 1 is exteriorly covered with the heat-insulating material 7. Further, in the electric furnace of the present invention, the heating element 1 has the terminal portions 2 larger in the cross-sectional area than the heat-generating portion 3, so that an opening may be formed between the heat-generating portion 3 and heat-insulating material 7 depending on the structure of the electric furnace, thereby enhancing the heat-insulating effect. Useful heat-insulating materials are not specifically limited and include conventional heat-insulating materials such as refractory brick, refractory heat-insulating brick, castable refractories, moldings of ceramic fibers, etc. There is no specific restriction on the kind of components useful for heat-insulating materials, but it is preferred to use an alumina component, alumina/silica component, zirconia component and so on. If these components are used, a reaction can be inhibited between the heat-insulating material component and the heating element 1. Since ceramic fiber moldings are superior in heat-insulating property and small in heat storage quantity, they can reduce the electric power to be consumed in heating the electric furnace, giving an extended duration of life to the heating element 1. Depending on the design of the electric furnace, the specific requirements for the heat-insulating material 7 are determined as to the kind of material, purity, bulk density, heat conductivity, coefficient of thermal expansion, form, shape, etc. The heat-insulating material to be used is not limited to one kind, but a plurality of insulating materials can be used in combination.

Figure 9A:
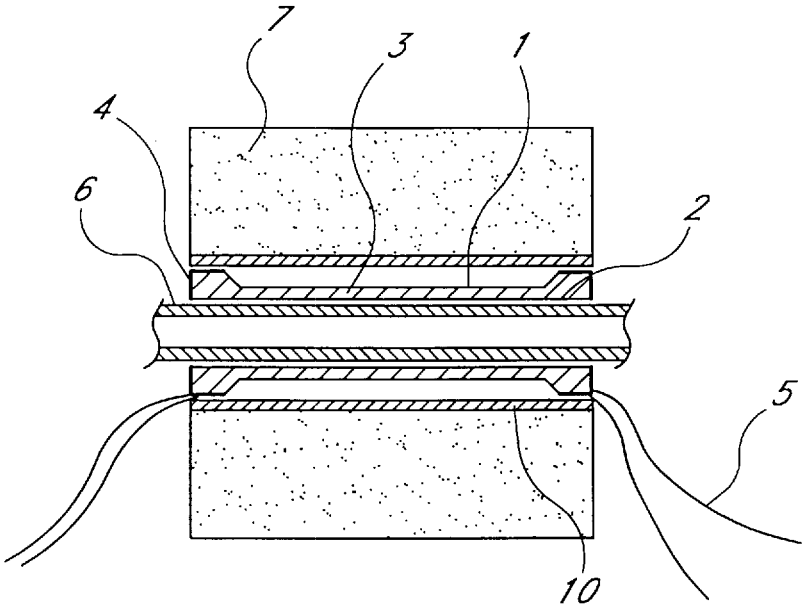
FIG. 9 (A) is a longitudinal section of another example of the electric furnace according to the invention.
Figure 9B:
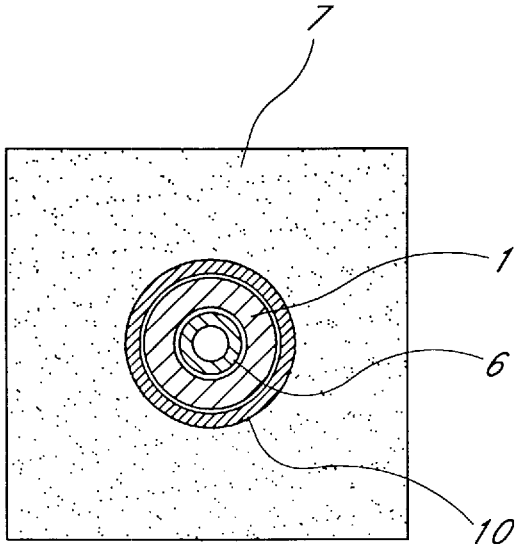

FIG. 9 shows sectional views illustrating another example of the electric furnace according to the present invention.

In the electric furnace illustrated in FIG. 9, a ceramic layer 10 is formed between the heating element 1 and the heat-insulating material 7. This structure more inhibits a reaction between the heat-insulating material 7 and the heating element 1. Especially when a molded product of ceramic fibers which is brittle is used as the heat-insulating material 7, a reaction can be prevented more effectively between the fiber component and the heating element 1 by forming a ceramic layer 10 between the heating element 1 and the heat-insulating material 7. The ceramic layer 10 can be formed by inserting for example a hollow ceramic member between the heating element 1 and the heat-insulating material 7, said ceramic layer being one produced from the same material as used for the hollow ceramic member 6 serving as the furnace tube.

For entry of an object to be heated, a hole or a slit may be formed over part of the length or the entire length of the heat-insulating material 7 (which includes the ceramic layer 10, if formed between the heating element 1 and the heat-insulating material 7), the heating element 1 and the hollow ceramic member 6 housed therein. If such hole or slit is formed, an object to be heated may be easily inserted into or withdrawn from the heating chamber. In this case, the electric furnace has a structure which is superior in handleability.

According to the present invention, the following remarkable results can be obtained.

(1) The electric furnace is operative at high temperatures and has an extended duration of life.

(2) The electric furnace has a small-size, simplified structure.

(3) The heating efficiency is high and the required electric power consumption can be reduced.

(4) The entire length of the electric furnace can be shortened and further the length of soaking zone can be extended.

(5) The pollution of an object to be heated can be prevented.

BEST MODE FOR CARRYING OUT THE INVENTION

Examples are given below to illustrate the present invention in more detail with reference to the accompanying drawings.

EXAMPLE 1

In the electric furnace shown in FIG. 2, a hollow lanthanum chromite ceramic element was used as a heating element 1. The hollow ceramic element had the composition and properties shown in Table 1 and measured 5 mm in the inside diameter, 9 mm in the outer diameter of a terminal portion 2 (2.5 mm in the length), 7 mm in the outer diameter of a heat-generating portion 3 (23 mm in the length) and 30 mm in the entire length. Electrodes and metallic lead wires were fixed to the terminal portions 2 in the same manner as the mode shown in FIG. 7. Grooves of 1.2 mm width and 0.3 mm depth were formed at a position 0.5 mm inwardly away from both ends of the heating element 1. A platinum paste was applied to a portion (outer peripheral surface and end surface) extending over a distance of 2 mm from both ends of the heating element 1. A platinum wire of 0.5 mm diameter and 12 cm length was wound two-fold on the platinum layer, a platinum paste was further applied to the wound wire, and the layers were baked at 1,300° C. to provide high-temperature electrodes 4 and metallic lead wires 5. Into the empty space in the interior of the heating element 1 was inserted an alumina hollow ceramic member 6 having a purity of 99.5% and a relative density of 97% (hereinafter referred to as "furnace tube") (with an outer diameter of 4.5 mm, an inside diameter of 2 mm and a length of 40 mm). Heat-insulating alumina refractory brick was laid as a heat-insulating material 7 outside the heating element 1, the brick having a purity of 98% and a bulk density of 1.4 g/cm$^3$ and measuring 30 mm in the width, 30 mm in the height and 30 mm in the length, said brick including a through hole of 9.5 mm diameter in the center. An alumina paste was applied to both ends of the furnace tube 6, the heating element 1 and the heat-insulating material 7, respectively. Then the paste layer thus applied was sintered at 1,500° C. to fix the components, whereby an electric furnace was produced.

EXAMPLE 2

An electric furnace was produced in the same manner as in Example 1 except for the following changes. In the electric furnace shown in FIG. 9, a hollow alumina ceramic member 10 having a purity of 99.5% and a relative density of 97% (with an outer diameter of 11 mm, an inside diameter of 9.5 mm and a length of 30 mm) was placed outside the heating element 1. Outside said member 10, a molded product of α-alumina fibers having a purity of 95% and a bulk density of 0.7 g/cm$^3$ was fitted as a heat-insulating material 7 (the molded product measuring 30 mm in the width, 30 mm in the height and 30 mm in the length and having a through hole of 11 mm diameter in the center). Electrodes and metallic lead wires were fixed in the same manner as in Example 1.

EXAMPLE 3

An electric furnace was produced in the same manner as in Example 2 except for the following change. In the electric furnace shown in FIG. 10, a hollow lanthanum chromite ceramic element was used as a heating element 1. The hollow element measured 5 mm in the inside diameter, 9 mm in the outer diameter of a terminal portion 2 (2.5 mm in the length), 8 mm in the outer diameter of a heat-generating portion 3*a* (7 mm in the length), 7 mm in the outer diameter of a heat-generating portion 3*b* (3.5 mm in the length) and 30 mm in the entire length. Electrodes and metallic lead wires were fixed in the same manner as in Example 1.

EXAMPLE 4

Figure 11A:
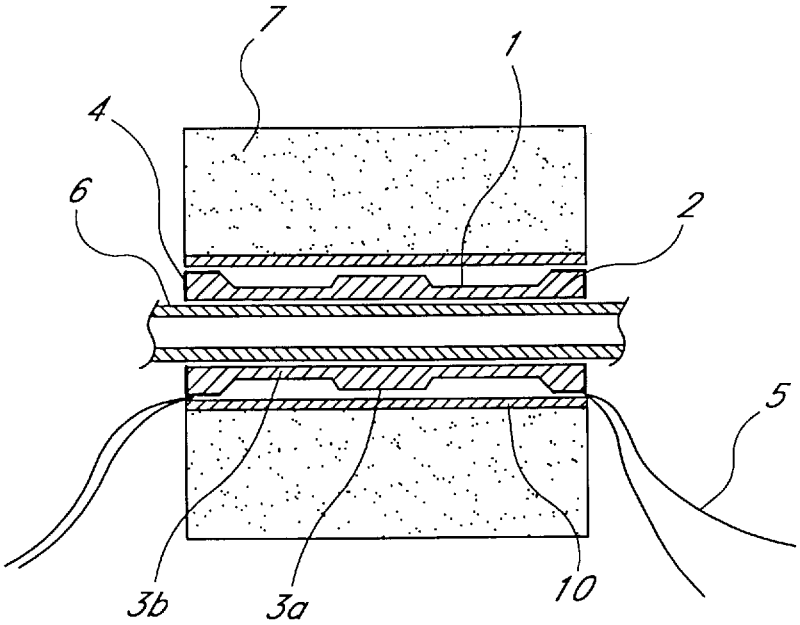
FIG. 11 (A) is a longitudinal section of the electric furnace of Example 4.
Figure 11B:
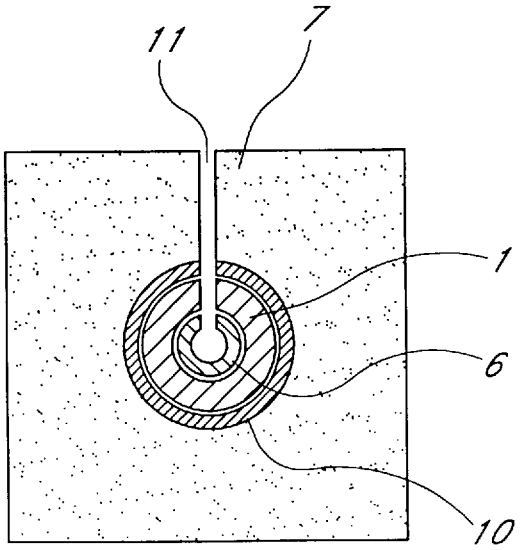

An electric furnace was produced in the same manner as in Example 3 except for the following changes. In the electric furnace shown in FIG. 11, a heating element 1 was produced from a lanthanum chromite ceramic having the composition and the properties indicated in Table 1. A slit 11 of 1 mm width extending over the entire length was formed through all of a furnace tube 6 inserted in the empty space in the interior of a heating element 1, the heating element 1, an alumina pipe 10 laid outside the heating element 1 and a molded product 7 of alumina fibers. Electrodes and metallic lead wires were fixed in the same manner as in Example 1.

EXAMPLE 5

Figure 10A:
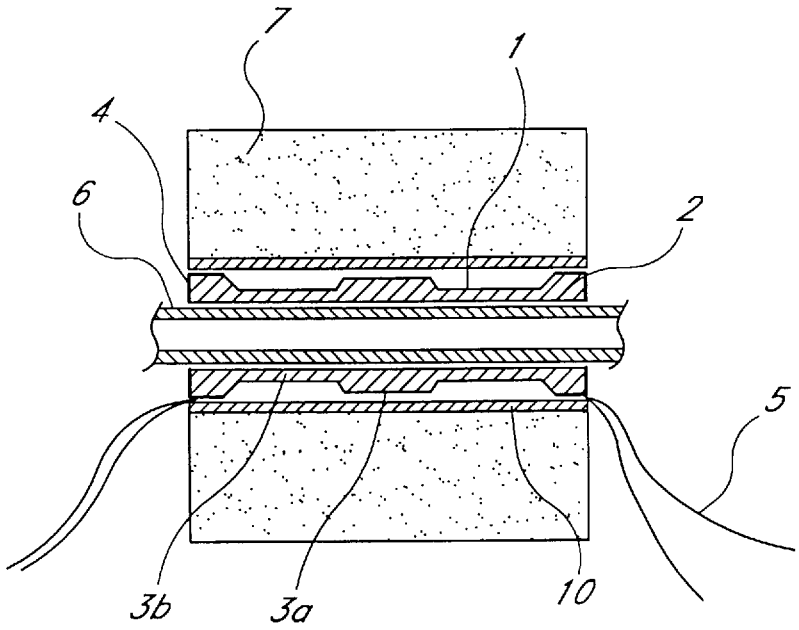
FIG. 10 (A) is a longitudinal section of the electric furnace of Example 3.
Figure 10B:
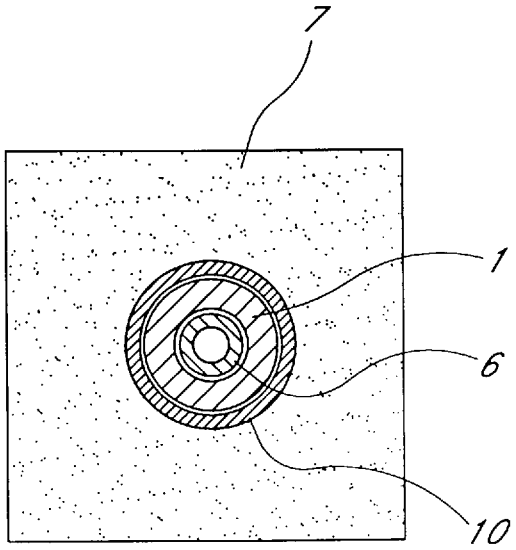

The electric furnace shown in FIG. 10 was produced in the same manner as in Example 3 except for the following changes. A heating element 1 was produced from a lanthanum chromite ceramic having the composition and the properties indicated in Table 1. High-temperature electrodes 4 and metallic lead wires 5 were made of an alloy consisting of 80% platinum and 20% rhodium. A furnace tube 6 to be placed into the empty space in the interior of the heating element 1 was made of spinel having a purity of 97% and a relative density of 96%.

EXAMPLE 6

The electric furnace shown in FIG. 10 was produced in the same manner as in Example 5 except for the following changes. A heating element 1 was produced from a lanthanum chromite ceramic having the composition and the properties indicated in Table 1. A furnace tube 6 to be placed into the empty space in the interior of the heating element 1 was made of zirconia stabilized with $Y_2O_3$, the total content of zirconia and $Y_2O_3$ being 99% and the stabilized zirconia having a relative density of 97%. A hollow alumina ceramic member 10 was laid outside the heating element 1, the member 10 having a purity of 99.5% and a relative density of 97% (with an outer diameter of 11 mm, an inside diameter of 9.5 mm and a length of 30 mm). A molded product of alumina/silica fibers having a bulk density of 0.5 g/cm$^3$ was fitted as a heat-insulating material 7 outside the layer 10. The molded product measured 30 mm in the width, 30 mm in the height and 30 mm in the length and had a through hole of 11 mm diameter in the center.

EXAMPLE 7

The electric furnace shown in FIG. 10 was produced in the same manner as in Example 3 except for the following changes. High-temperature electrodes 4 and metallic lead wires 5 were formed using a gold paste and gold wires of 1.0 mm diameter and 12 cm length.

EXAMPLE 8

The electric furnace shown in FIG. 10 was produced in the same manner as in Example 5 except for the following change. A furnace tube 6 to be admitted into the empty space in the interior of a heating element 1 was made of alumina having a purity of 92.5% and a relative density of 92%.

EXAMPLE 9

The electric furnace shown in FIG. 10 was produced in the same manner as in Example 5 except for the following change. A furnace tube 6 to be placed into the empty space in the interior of a heating element 1 was made of mullite having a purity of 99.8% and a relative density of 96%.

EXAMPLE 10

The electric furnace shown in FIG. 10 was produced in the same manner as in Example 5 except for the following change. A furnace tube 6 to be placed into the empty space in the interior of a heating element 1 was made of yttria-stabilized zirconia having a purity of 97% and a relative density of 95%.

EXAMPLE 11

The electric furnace shown in FIG. 10 was produced in the same manner as in Example 5 except for the following change. A furnace tube 6 to be placed into the empty space in the interior of a heating element 1 was made of magnesia having a purity of 98.5% and a relative density of 95%.

EXAMPLE 12

The electric furnace shown in FIG. 10 was produced in the same manner as in Example 5 except for the following change. A furnace tube 6 to be placed into the empty space in the interior of a heating element 1 was made of yttria having a purity of 98% and a relative density of 96%.

TABLE 1

| | Composition of Heating Element | | | | | | Properties | |
|---|---|---|---|---|---|---|---|---|
| Ex. | Composition Formula | x | y | z | x + y | y + z | Porosity (%) | Bending strength ($kgf/mm^2$) |
| 1 | $La_{0.98}Ca_{0.02}Cr_{0.85}Al_{0.15}O_3$ | 0.02 | 0 | 0.15 | 0.02 | 0.15 | 4 | 15 |
| 2 | $La_{0.98}Ca_{0.02}Cr_{0.85}Al_{0.15}O_3$ | 0.02 | 0 | 0.15 | 0.02 | 0.15 | 4 | 15 |
| 3 | $La_{0.98}Ca_{0.02}Cr_{0.85}Al_{0.15}O_3$ | 0.02 | 0 | 0.15 | 0.02 | 0.15 | 4 | 15 |
| 4 | $La_{0.98}Sr_{0.02}Cr_{0.90}Al_{0.10}O_3$ | 0.02 | 0 | 0.10 | 0.02 | 0.10 | 5 | 14 |
| 5 | $La_{0.99}Sr_{0.01}Cr_{0.65}Mg_{0.05}Al_{0.30}O_3$ | 0.01 | 0.05 | 0.30 | 0.06 | 0.35 | 6 | 13 |
| 6 | $LaCr_{0.60}Mg_{0.05}Al_{0.35}O_3$ | 0 | 0.05 | 0.35 | 0.05 | 0.40 | 6 | 14 |
| 7 | $La_{0.98}Ca_{0.02}Cr_{0.85}Al_{0.15}O_3$ | 0.02 | 0 | 0.15 | 0.02 | 0.15 | 4 | 15 |
| 8 | $La_{0.99}Sr_{0.01}Cr_{0.65}Mg_{0.05}Al_{0.30}O_3$ | 0.01 | 0.05 | 0.30 | 0.06 | 0.35 | 6 | 13 |
| 9 | $La_{0.99}Sr_{0.01}Cr_{0.65}Mg_{0.05}Al_{0.30}O_3$ | 0.01 | 0.05 | 0.30 | 0.06 | 0.35 | 6 | 13 |
| 10 | $La_{0.99}Sr_{0.01}Cr_{0.65}Mg_{0.05}Al_{0.30}O_3$ | 0.01 | 0.05 | 0.30 | 0.06 | 0.35 | 6 | 13 |
| 11 | $La_{0.99}Sr_{0.01}Cr_{0.65}Mg_{0.05}Al_{0.30}O_3$ | 0.01 | 0.05 | 0.30 | 0.06 | 0.35 | 6 | 13 |
| 12 | $La_{0.99}Sr_{0.01}Cr_{0.65}Mg_{0.05}Al_{0.30}O_3$ | 0.01 | 0.05 | 0.30 | 0.06 | 0.35 | 6 | 13 |

COMPARATIVE EXAMPLE 1

An electric furnace was produced using three commercially available cylindrical heating elements made of a lanthanum chromite in place of the hollow lanthanum chromite ceramic element used as the heating element 1 in the electric furnace of FIG. 2 in Example 1. The three heating elements measured 5 mm in the outer diameter, 23 mm in the length of a heat-generating portion, and 60 mm in the entire length (the composition of a heat-generating portion: $La_{0.98}Ca_{0.02}CrO_3$, the composition of a terminal portion: $La_{0.90}Ca_{0.10}CrO_3$, the porosity of the heat-generating portion: 14%, the bending strength of the heat-generating portion: 7 $kgf/mm^2$ and the electrodes and metallic lead wires being made of silver) (product of Nikkato Corp., trade name "KERAMAX"). The three heating elements were laid outside a furnace tube 6 (one made of the same material with the same size as in Example 1). The furnace tube 6 had the same effective internal volume as the electric furnace of Example 1. A refractory made of the same material as used in Example 1 (100 mm in the outer diameter, 23 mm in the inside diameter and 40 mm in the length) was arranged as a heat-insulating material 7 outside the three heating elements.

COMPARATIVE EXAMPLE 2

An electric furnace was produced in the same manner as in Example 1 with the exception of using, as a heating element 1, a hollow element of a lanthanum chromite ceramic having the same composition and the same properties as the material used in Example 1, but lacked a terminal portion. The hollow element measured 5 mm in the inside diameter, 7 mm in the outer diameter and 30 mm in the entire length.

COMPARATIVE EXAMPLE 3

An electric furnace was produced in the same manner as in Example 1 except that a furnace tube was not inserted in the empty space in the interior of a heating element 1 in the electric furnace of Example 1.

TEST EXAMPLE 1

The electric furnaces produced in Examples 1 to 12 and Comparative Examples 1 to 3 were heated to 1,650° C. in the center of effective heating chamber of the electric furnace, and there were determined: electric power consumption; the length of a temperature zone showing a temperature not lower than 1,500° C. in the furnace (length of soaking zone); and a time period involved until the breakdown of the heating element. The results are shown in Table 2.

TABLE 2

| | Performance of Electric Furnace | | |
|---|---|---|---|
| | Electric power consumption (W) | Length of soaking zone (mm) | Duration of life (hr) |
| Ex. | | | |
| 1 | 158 | 18.3 | 1,430 |
| 2 | 105 | 19.0 | >2,000 |
| 3 | 110 | 20.1 | >2,000 |
| 4 | 118 | 18.9 | 1,880 |
| 5 | 110 | 19.5 | >2,000 |
| 6 | 112 | 19.4 | 1,700 |
| 7 | 113 | 19.4 | 700 |
| 8 | 114 | 19.3 | 820 |
| 9 | 109 | 20.2 | >2,000 |
| 10 | 112 | 19.5 | 1,650 |
| 11 | 113 | 19.4 | 1,600 |
| 12 | 110 | 19.7 | >2,000 |
| Com. Ex. | | | |
| 1 | 298 | 14.1 | 390 |
| 2 | 160 | 47.4 | 480 |
| 3 | 148 | 18.0 | — |

As seen from Table 2, the electric furnaces of Examples 1 to 12 showed good durability and had a long length of soaking zone. Further advantageously, these furnaces had such high strength that they exhibited high durability even when repeating a cycle consisting of raising the temperature from 1,000° C. to 1,650° C. in 3 minutes, maintaining the temperature at 1,650° C. for 3minutes and lowering the temperature to 1,000° C. in 3 minutes. The electric furnace of Example 2 noticeably reduced the electric power consumption in heating to 1,650° C. due to the arrangement of a molded product of alumina fibers as a heat-insulating material and a layer of alumina ceramic having a purity of 99.5% and a relative density of 97% inside the molded body. In addition, the contamination or reaction of the heating element with fragments of molded product was inhibited by the alumina ceramic layer between the heating element and the molded product of alumina fibers, whereby the duration of life was markedly extended. In the electric furnace of Example 3, the length of soaking zone was extended by enlarging the cross-sectional area of only the central portion of the heat-generating portion on a plane perpendicular to the longitudinal direction of the heating element. In the electric furnace of Example 4, a slit 11 of 1 mm width for entry of an object to be heated was formed over the entire length of all of a molded product 7 of alumina fibers, an alumina tube 10 arranged outside the heating element 1, the heating element 1 and a furnace tube 6 inserted in the empty space in the interior of the heating element 1. The electric furnace of Example 4 had a long length of soaking zone and high durability like that of Example 3. The electric furnaces of Examples 5 to 12 had excellent performance like that of Example 3.

The electric furnace of Comparative Example 1 had a structure wherein three commercial cylindrical heating elements are laid outside a furnace tube 6. The electric furnace of Comparative Example 1 had an outer diameter of 100 mm and was very large, expensive and narrow in the length of soaking zone as compared with the furnace of the present invention. In the elevation of temperature to 1,650° C., the furnace of Comparative Example 1 required about 1.9 times the electric power consumed by and 3 times the period of time taken by the furnace of the invention. Further, the furnace of Comparative Example 1 was inferior in durability. When the temperature was repeatedly raised or lowered, the furnace of Comparative Example 1 was poor in response particularly to the elevation of temperature and consumed greater electric power, consequently showing merely about ⅓ the durability of the furnace of the invention. In the electric furnace of Comparative Example 2, the electrodes were exposed to high temperatures because of the lack of a terminal portion on the heating element so that the electrodes and leading wires were appreciably degraded, thereby reducing the durability of the furnace. In the electric furnace of Comparative Example 3, Cr vapor was diffused in the furnace because of lack of a furnace tube, inhibiting heat treatment in a clean atmosphere so that the long-time durability test was stopped after 100 hours.

EXAMPLES 13 TO 21

The electric furnaces shown in FIG. 10 were produced in the same manner as in Example 3 except that a heating element 1 was produced from a lanthanum chromite ceramic having the composition and the properties indicated in Table 3.

COMPARATIVE EXAMPLE 4

The electric furnace shown in FIG. 10 was produced in the same manner as in Example 3 except that a heating element 1 was produced from a lanthanum aluminate ceramic having the composition and the properties indicated in Table 3.

TABLE 3

| | Composition of Heating Element | | | | | | Properties | |
|---|---|---|---|---|---|---|---|---|
| | Composition formula | x | y | z | x + y | y + z | Porosity (%) | Bending strength (kgf/mm$^2$) |
| Ex. | | | | | | | | |
| 13 | $La_{0.98}Ca_{0.02}CrO_3$ | 0.02 | 0 | 0 | 0.02 | 0 | 14 | 7 |
| 14 | $La_{0.85}Sr_{0.15}Cr_{0.80}Mg_{0.10}Al_{0.10}O_3$ | 0.15 | 0.10 | 0.10 | 0.25 | 0.20 | 5 | 13 |
| 15 | $La_{0.98}Sr_{0.02}Cr_{0.90}Al_{0.10}O_3$ | 0.02 | 0 | 0.10 | 0.02 | 0.10 | 5 | 14 |
| 16 | $La_{0.90}Ca_{0.10}Cr_{0.65}Al_{0.35}O_3$ | 0.10 | 0 | 0.35 | 0.10 | 0.35 | 4 | 15 |
| 17 | $La_{0.995}Cr_{0.005}Cr_{0.65}Mg_{0.05}A_{0.30}O_3$ | 0.005 | 0.05 | 0.30 | 0.055 | 0.35 | 5 | 15 |
| 18 | $La_{0.99}Sr_{0.01}Cr_{0.80}Mg_{0.10}Al_{0.10}O_3$ | 0.01 | 0.10 | 0.10 | 0.11 | 0.20 | 5 | 14 |
| 19 | $La_{0.99}Ca_{0.01}Cr_{0.88}Mg_{0.10}Al_{0.02}O_3$ | 0.01 | 0.10 | 0.02 | 0.11 | 0.12 | 6 | 13 |
| 20 | $La_{0.98}Sr_{0.02}Cr_{0.78}Mg_{0.02}Al_{0.20}O_3$ | 0.02 | 0.02 | 0.20 | 0.04 | 0.22 | 2 | 14 |
| 21 | $La_{0.88}Pr_{0.10}Sr_{0.02}Cr_{0.78}Mg_{0.02}Al_{0.20}O_3$ | 0.02 | 0.02 | 0.20 | 0.04 | 0.22 | 3 | 14 |
| Com. Ex. | | | | | | | | |
| 4 | $La_{0.95}Ca_{0.05}Cr_{0.35}Mg_{0.05}Al_{0.60}O_3$ | 0.05 | 0.05 | 0.60 | 0.10 | 0.65 | 3 | 15 |

TEST EXAMPLE 2

The electric furnaces produced in Examples 13 to 21 and Comparative Example 4 were heated to 1,650° C. in the center of effective heating chamber in the furnace, and there were determined: electric power consumption; a length of a temperature zone showing a temperature not lower than 1,500° C. in the effective heating chamber (length of soaking zone); and a time period involved until the breakdown of the heating element. The results are shown in Table 4.

TABLE 4

| | Performance of Electric Furnace | | |
|---|---|---|---|
| | Electric power consumption (W) | Length of soaking zone (mm) | Duration of life (hr) |
| Ex. | | | |
| 13 | 116 | 19.4 | 750 |
| 14 | 116 | 19.2 | 630 |
| 15 | 110 | 20.1 | >2,000 |

TABLE 4-continued

| | Performance of Electric Furnace | | |
|---|---|---|---|
| | Electric power consumption (W) | Length of soaking zone (mm) | Duration of life (hr) |
| 16 | 115 | 19.6 | 1,700 |
| 17 | 113 | 19.8 | 1,840 |
| 18 | 111 | 19.2 | >2,000 |
| 19 | 115 | 19.3 | 1,850 |
| 20 | 112 | 19.7 | >2,000 |
| 21 | 113 | 19.4 | >2,000 |
| Com. Ex. | | | |
| 4 | 116 | 19.2 | 300 |

The electric furnaces of Examples 13 to 21 were superior in durability and had a long length of soaking zone. Further advantageously, these furnaces had such high strength that they showed high durability even when repeating a cycle consisting of raising the temperature from 1,000° C. to 1,650° C. in 3 minutes, maintaining the temperature at 1,650° C. for 3 minutes and lowering the temperature to 1,000° C. in 3 minutes. Particularly when using a ceramic having a specific composition represented by $La_{1-x}A_xCr_{1-y-z}Mg_yAl_zO_3$, the evaporation of Cr component was more inhibited and the electric furnace was provided as a low-current driving type, so that the durability of the furnace was noticeably improved.

The electric furnace of Comparative Example 4 had a heating element 1 made of a lanthanum aluminate ceramic in the form of a substitutional solid solution involving a large substitution amount of Al component. Thus, the furnace was very low in durability.

We claim:

1. An electric furnace comprising:

a heating element which is a hollow element made of a lanthanum chromite ceramic having an interior with two open ends in a longitudinal direction, said heating element having terminal portions at the two open ends, and a heat-generating portion between the terminal portions, said terminal portions having a cross-sectional area larger than that of the heat-generating portion on a plane perpendicular to the longitudinal direction, said heating element further comprising high-temperature electrodes and metallic lead wires being attached to the terminal portions to generate heat in the heat-generating portion;

a heat-insulating material surrounding the heating element: and a hollow ceramic member placed in the interior of the heating element, said hollow ceramic member having an interior which constitutes a heat chamber.

2. The electric furnace according to claim 1, wherein the lanthanum chromite ceramic for forming the heating element is a sintered product represented by the formula $La_{1-x}A_xCr_{1-y-z}Mg_yAl_zO_3$ in which A is at least one selected from the group consisting of Ca and Sr, $0 \leqq x \leqq 0.12$, $0 \leqq y \leqq 0.20$, $0 < z \leqq 0.50$, $0.005 \leqq x+y \leqq 0.20$ and $0.03 \leqq y+z \leqq 0.50$, the sintered product having a porosity of 10% or less.

3. The electric furnace according to claim 2, wherein the lanthanum chromite ceramic for forming the heating element is in the form of a substitutional solid solution of the sintered product of the formula $La_{1-x}A_xCr_{1-y-z}Mg_yAl_zO_3$ in which 1 to 35 mol % of La is substituted with at least one selected from the group consisting of yttrium and rare earth elements of atomic number 58–71.

4. The electric furnace according to claim 1, wherein the interior of the heating element has a cross-sectional area of 1 to 2,000 $mm^2$ on a plane perpendicular to the longitudinal direction of the heating element.

5. The electric furnace according to claim 1, wherein the high-temperature electrodes and metallic lead wires are made of platinum, rhodium or a platinum-rhodium alloy.

6. The electric furnace according to claim 1, wherein the hollow ceramic member placed inside the interior of the heating element is made of one member selected from the group consisting of alumina, mullite, spinel, stabilized zirconia, magnesia and yttria which have a purity of at least 95% and a relative density of at least 93%.

7. The electric furnace according to claim 1, wherein the heat-insulating material is made of at least one member selected from the group consisting of alumina, alumina-silica and zirconia materials, the heat-insulating material being in the form of refractory brick, refractory heat-insulating brick, castable refractories or moldings of ceramic fibers.

8. The electric furnace according to claim 1, wherein the heat-generating portion has portions having different cross-sectional areas on a plane perpendicular to the longitudinal direction of the heating element.

9. The electric furnace according to claim 1, wherein each of the heating element, the hollow ceramic member and the heat-insulating material has a hole or a slit for entry of a subject to be heated.

* * * * *